US005665248A

United States Patent [19]

McKiddy, II

[11] Patent Number: 5,665,248

[45] Date of Patent: Sep. 9, 1997

[54] METHOD OF PURGING AIR FROM A SWIMMING POOL HOSE

[76] Inventor: Clifford Ron McKiddy, II, 824 Ariege Dr., St. Louis, Mo. 63141

[21] Appl. No.: 529,914

[22] Filed: Sep. 18, 1995

[51] Int. Cl.[6] ..... B01D 35/01

[52] U.S. Cl. ..... 210/805; 210/169; 210/416.2; 4/496; 15/421

[58] Field of Search ..... 210/169, 416.2, 210/805; 15/1.7, 421; 4/496

[56] References Cited

U.S. PATENT DOCUMENTS 2,176,139 10/1939 Lofgren .
3,039,463 6/1962 Dickey, Jr. et al. .
3,048,876 8/1962 Kemnitz .
3,443,264 5/1969 Miller ..... 210/169
4,574,828 3/1986 Brumfield .
4,725,352 2/1988 Haliotis .
4,798,670 1/1989 Treene .
5,165,877 11/1992 Colin .

*Primary Examiner*—Robert Popovics
*Attorney, Agent, or Firm*—Kevin L. Klug

[57] ABSTRACT

An in-line priming device removably attached between the vacuum hose, skimmer/filter basket and the hydraulic pump of a conventional poolside skimmer/vacuum system. The in-line priming device having a plurality of apertures which are substantially immersed in the fluid to be pumped such that initially the hydraulic pump can alternatively siphon fluid through the plurality of apertures rather than exclusively through a vacuum hose containing a fluid/air mixture and thus retain sufficient fluid to maintain its prime. The in-line priming device having closing means which are capable of regulating the amount of fluid passing through the plurality of apertures of the in-line device such that the plurality of apertures can be substantially closed as the air is purged from the vacuum hose.

2 Claims, 5 Drawing Sheets

METHOD OF PURGING AIR FROM A SWIMMING POOL HOSE

BACKGROUND OF THE INVENTION

The present invention relates in general to priming devices for use with hydraulic pumping devices and pertains, more particularly, to an in-line priming device for use between a vacuum hose and a hydraulic pump as used with a conventional poolside skimmer/vacuum system. The priming device of this invention significantly improves the conventional poolside skimmer/vacuum system by decreasing the time and inconvenience of skimmer hose priming.

With conventional poolside skimmer/vacuum systems it is necessary to prefill the vacuum hose with fluid (e.g. water) before attachment of the skimmer/vacuum fittings and the hydraulic pump. Typically, a hydraulic pump cannot operate properly until the air within the system is purged. That is, the hydraulic pump must be primed with a fluid. Alternatives to the present invention include manual siphoning of air from the hose through the user's lungs, utilization of an auxiliary non-hydraulic pump, or holding the length of the hose under water until it completely fills. (It is important to note that a lightweight hose full of air is very buoyant and is therefore difficult to hold under water.) As such, all of the conventional alternatives are undesirable from both a convenience and efficiency standpoint.

Accordingly, it is an object of the present invention to provide an in-line priming device which is capable of being substantially immersed in the fluid to be pumped such that the hydraulic pump can alternatively siphon fluid through a plurality of apertures in the in-line priming device rather than rely on a recently immersed vacuum hose, often containing a fluid/air mixture, for sufficient fluid to maintain its prime.

Another object of the present invention is to provide an in-line priming device that is adapted for quick installation between a vacuum hose, a skimmer/filter basket assembly and a hydraulic pump of a conventional poolside skimmer/vacuum system.

A further object of the present invention is to provide an in-line priming device having closing means which are capable of regulating the amount of fluid passing through the plurality of apertures of the in-line device such that the plurality of apertures can be substantially closed as the air is purged from the vacuum hose, thereby maximizing suction through the vacuum hose.

SUMMARY OF THE INVENTION

To accomplish the foregoing and other objects of this invention there is provided an in-line priming device for substantially eliminating air from a fluid/air filled hose connected to a hydraulic vacuum pump. The in-line priming device is capable of connection between a vacuum hose and a hydraulic pump of a conventional poolside skimmer/vacuum unit.

The in-line device comprises a substantially L-shaped tubular member having a plurality of apertures and one or more covers capable of substantially closing the plurality of apertures.

In the preferred embodiment described herein, the substantially L-shaped tubular member has a front-end, a rear-end, an outer surface, an inner surface, a plurality of apertures interdisposed between the front-end and the rear-end, and one or more covers capable of substantially closing the plurality of apertures such that fluid flow through the plurality of apertures can be substantially controlled as air is purged from the vacuum hose.

Also, in the preferred embodiment, the plurality of apertures extend from the outer surface of the in-line tubular member to the inner surface of the in-line tubular member.

The front-end of the in-line tubular member is capable of direct connection to a hose and the rear-end of the in-line tubular member is capable of connection to a hydraulic vacuum pump, either directly or through a mounting plate mounted onto a skimmer/filter basket of a pool, such that the plurality of apertures are completely immersed in fluid.

In alternate embodiments, the in-line tubular member can have various shapes and sizes for facilitating both insertion of the in-line tubular member into a conventional skimmer filter basket and attachment of the tubular member between the vacuum hose and the hydraulic pump.

The in-line priming device can be manufactured of different materials, and also in different sizes and colors. In the preferred embodiment described herein, the in-line priming device comprises a polymeric-type material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
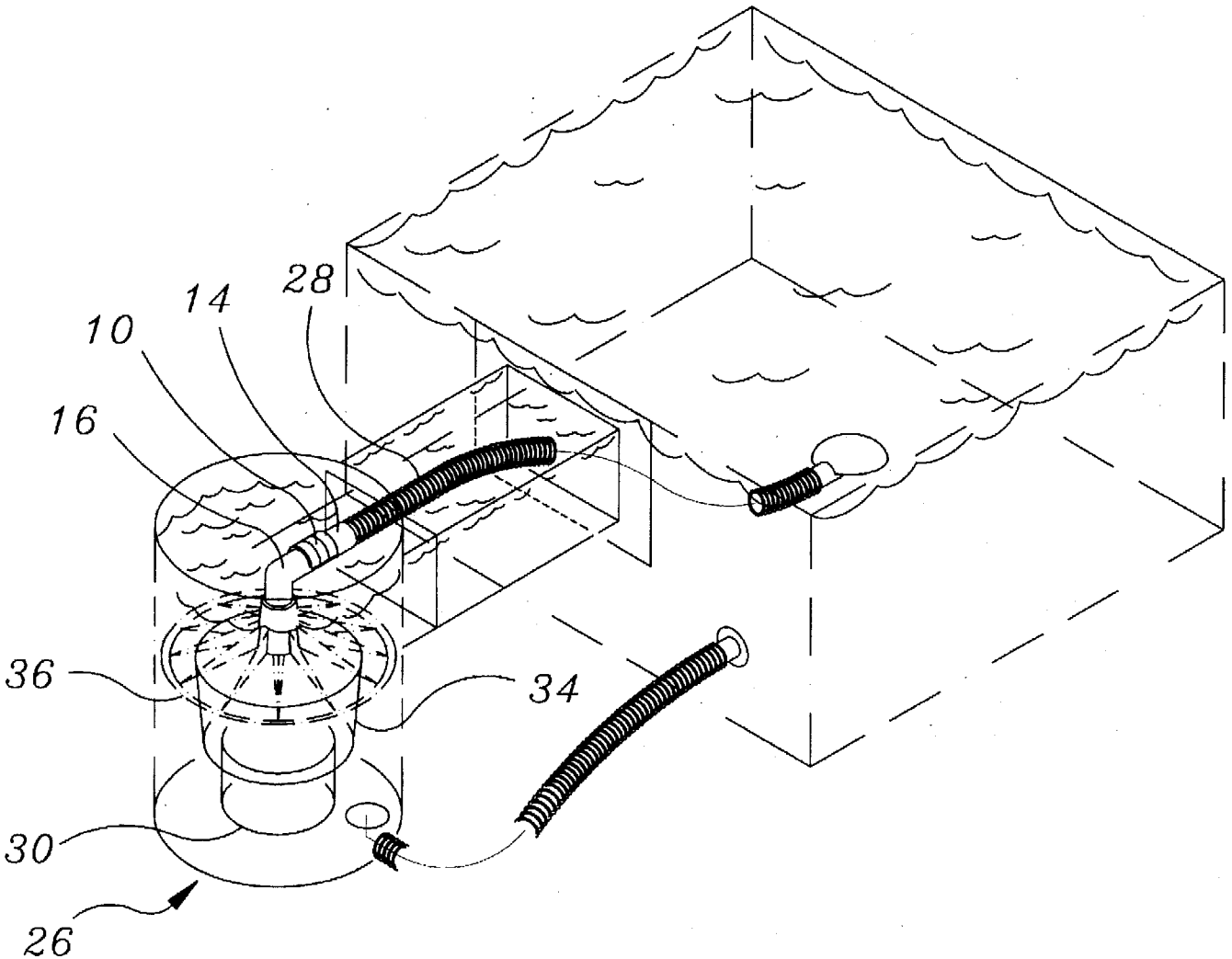
FIG. 1 is a perspective view of a preferred embodiment of the in-line priming device shown attached between a vacuum hose and a skimmer/filter basket plate mounted on the skimmer/filter basket of a conventional poolside skimmer/vacuum system.
Figure 2:
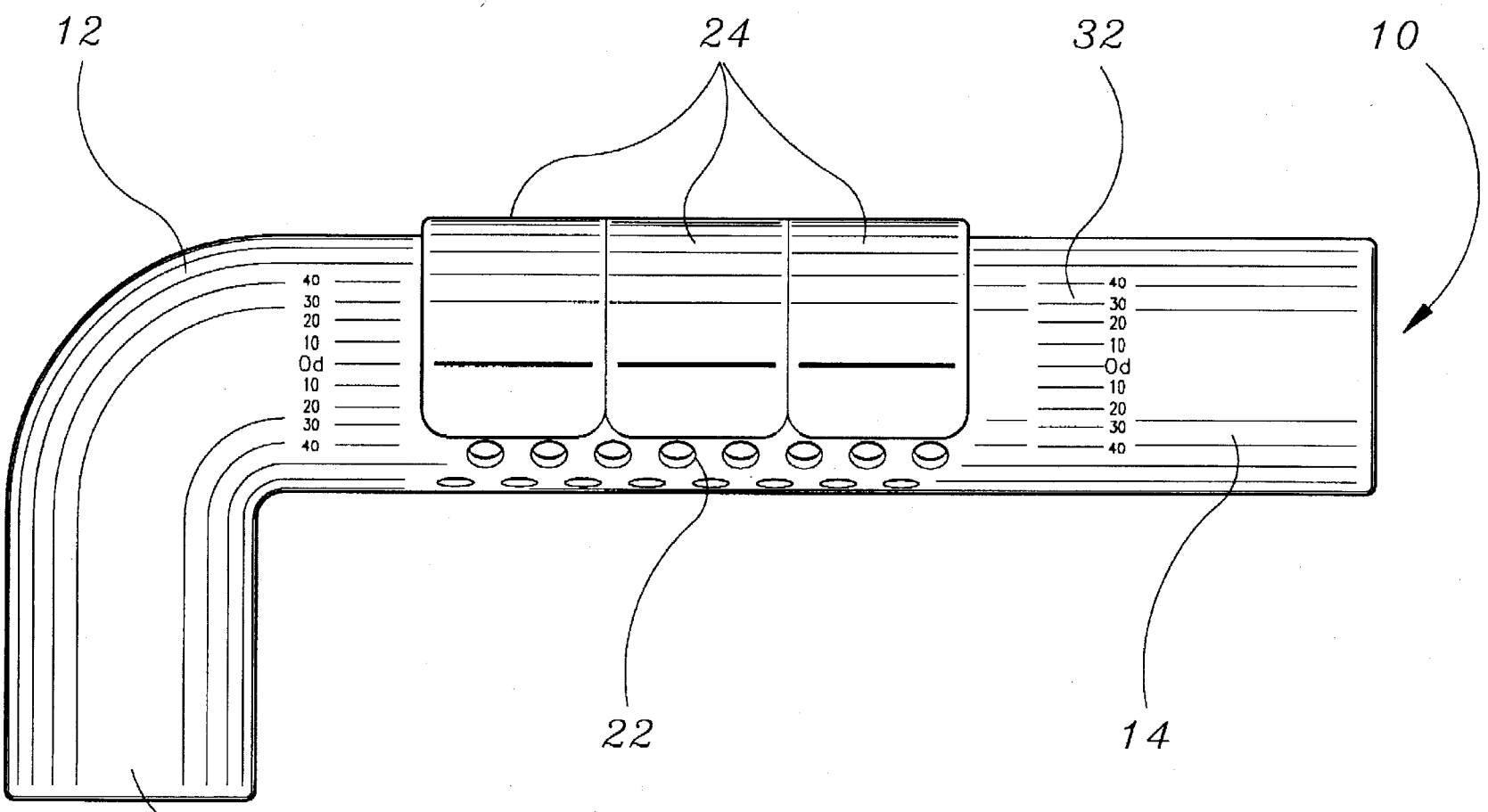
FIG. 2 is a plan view of the preferred embodiment of the in-line priming device.
Figure 3:
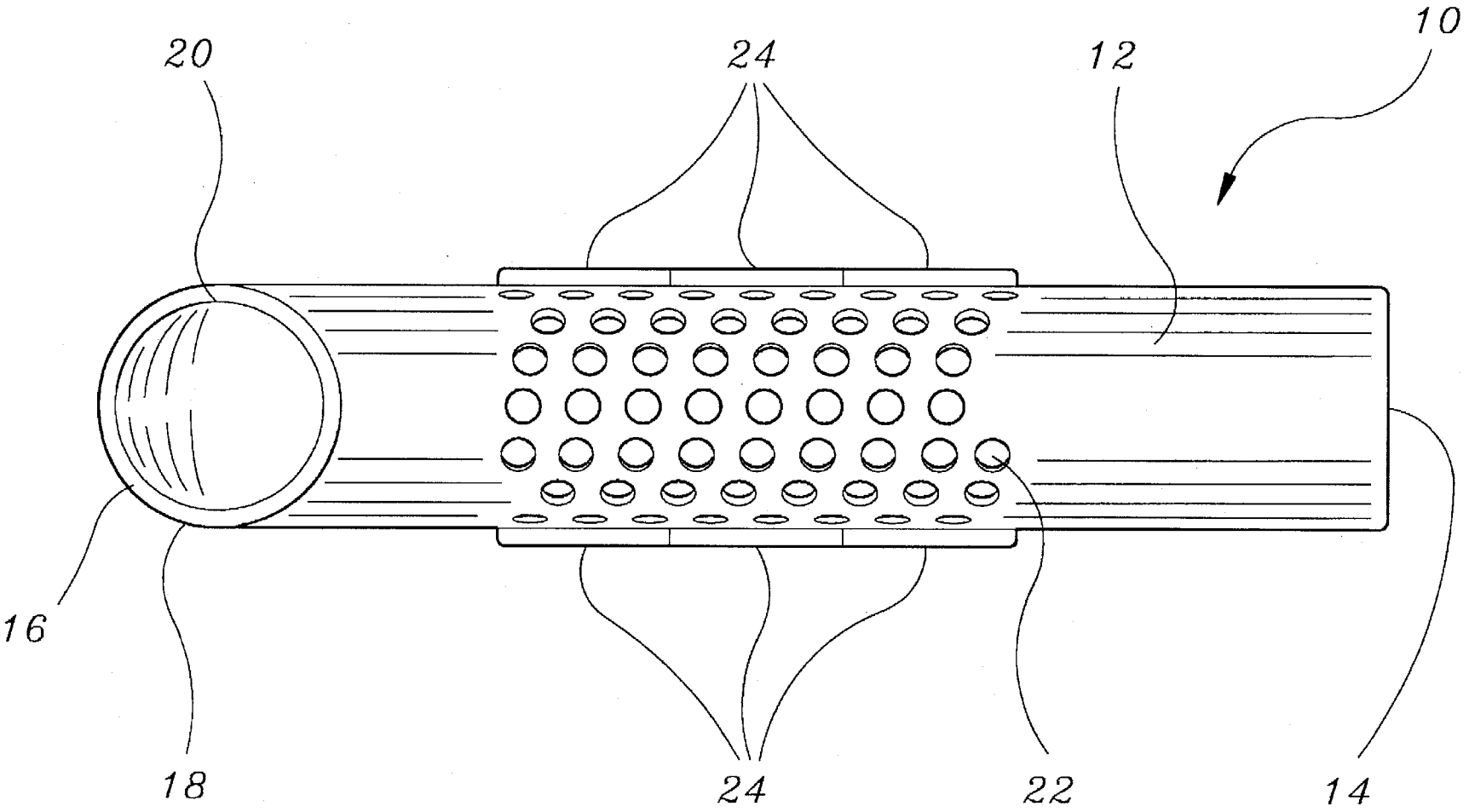
FIG. 3 is a bottom view of the preferred embodiment of the in-line priming device showing the closing means partially closed.
Figure 4:
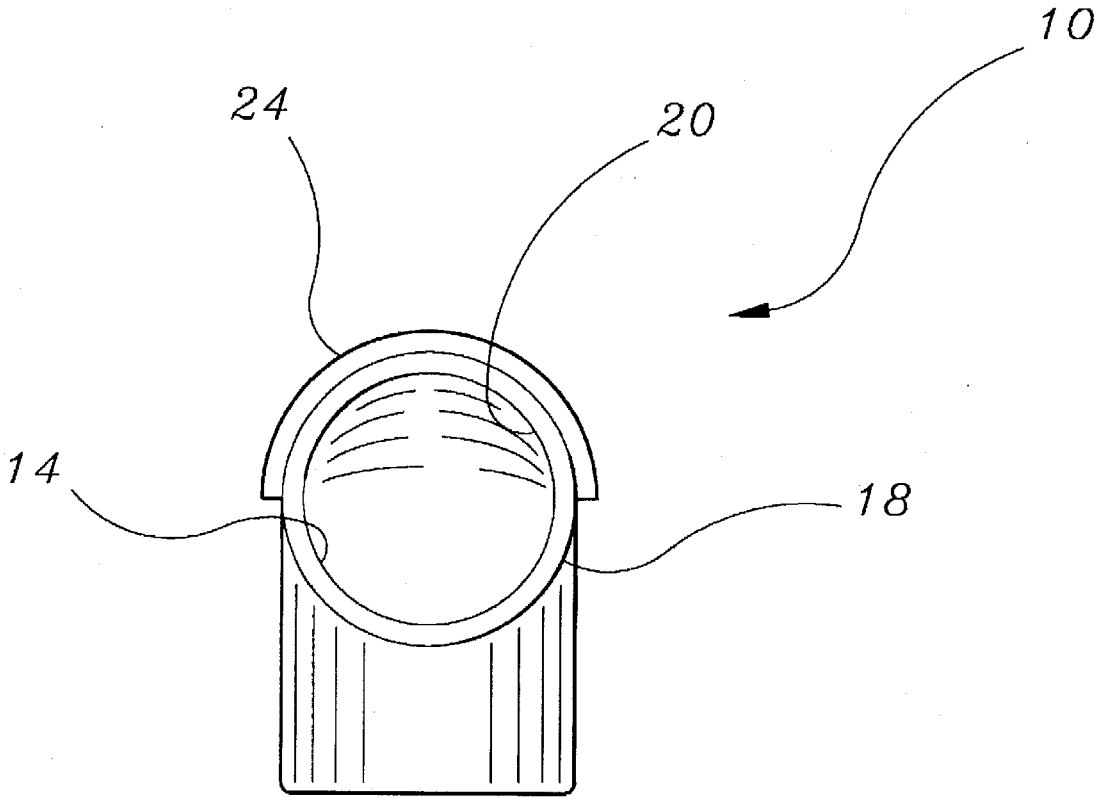
FIG. 4 is an end view of the preferred embodiment of the in-line priming device.

Referring now to the drawings there is shown a preferred embodiment in FIGS. 1–4 the in-line priming device of this invention. The in-line priming device is described in connection with a conventional poolside skimmer/vacuum system which utilizes a hydraulic pump, skimmer/filter basket and a vacuum hose. The in-line priming device of the present invention is particularly adapted for attachment between the vacuum hose and the skimmer/filter basket/hydraulic pump assembly in such a manner as to not hinder the functionality of the skimmer/vacuum while also providing for quick installation and removal from the system.

The drawings show the in-line priming device 10 in conjunction with a conventional poolside skimmer/vacuum system 26 having a vacuum hose 28, a basket plate 36, a skimmer/filter basket 34 and a hydraulic pump 30. The in-line priming device 10 comprises a substantially L-shaped tubular member 12 having a plurality of apertures and one or more covers 24 capable of substantially closing the plurality of apertures 22.

In a preferred embodiment, the tubular member 12 is substantially L-shaped and has a front-end 14, a rear end 16, an outer surface 18, inner surface 20 and a plurality of apertures 22 extending from the outer surface 18 to the inner surface 20 and interdisposed between the front-end 14 and the rear-end 16.

The front-end 14 is capable of attachment with a vacuum hose 28 and the rear-end 16 is capable of attachment with a basket plate 36 which is mounted on a skimmer/filter basket 34 which thereby interfaces to a hydraulic pump 30 such that the in-line priming device 10 is connected in-line and interdisposed between the vacuum hose 28 and the hydraulic pump 30.

Also in the preferred embodiment, the one or more covers 24 are pivotly mounted to the tubular member 12 such that the plurality of apertures 22 can be substantially closed thereby restricting the fluid flow through the plurality of apertures 22. Preferably, three covers are utilized for more precise control of the fluid flow through the apertures. The in-line priming device 10 preferably has indicia 32 for referencing the relationship between the plurality of apertures 22 and the one or more covers 24 such that the rate of fluid flow can be controlled with some degree of accuracy.

In a preferred embodiment, the in-line priming device 10 is comprised of a polymeric-type material although other material types could be used.

Figure 5:
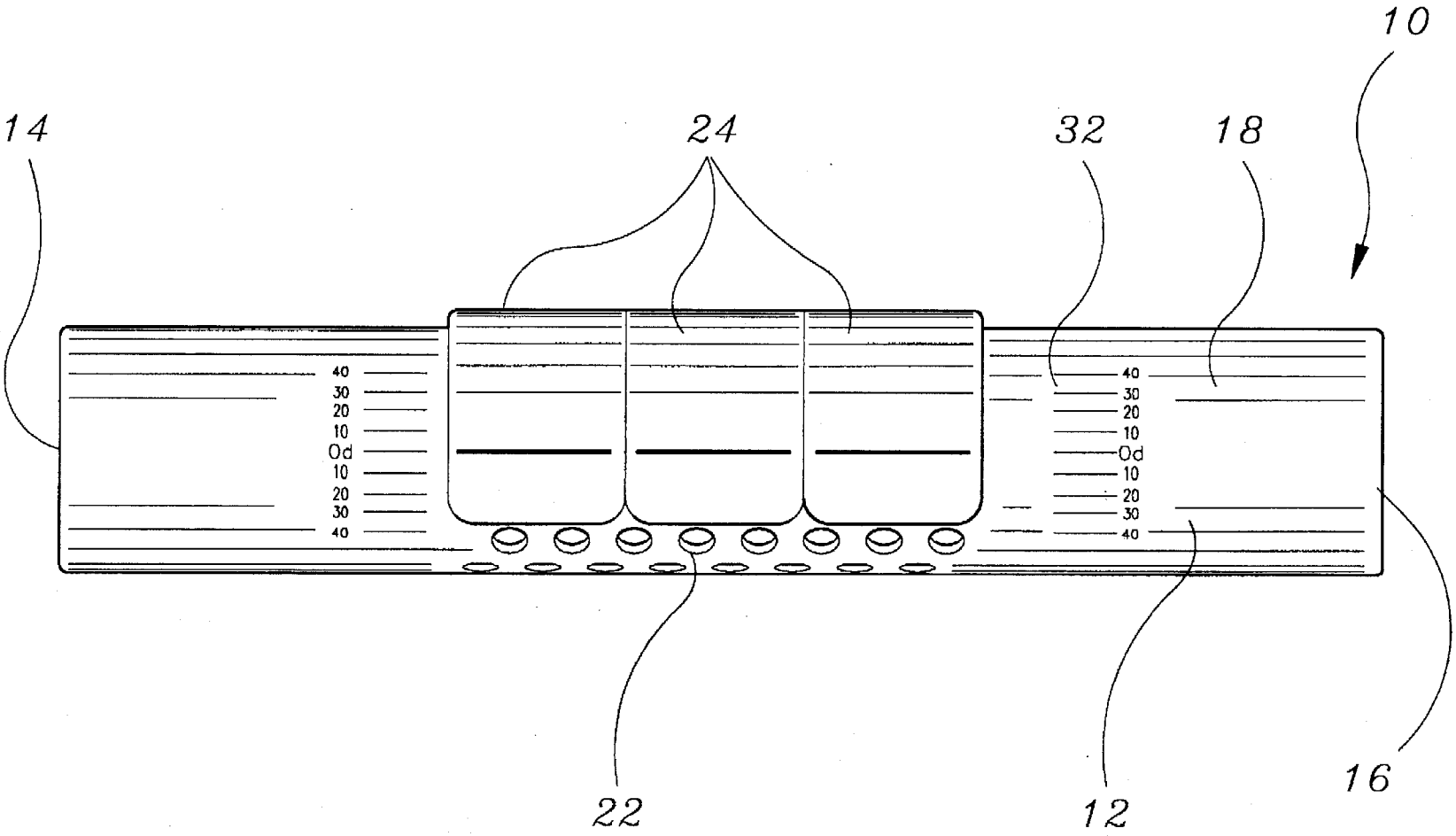
FIG. 5 is a plan view of the alternate embodiment of the in-line priming device.

FIG. 5 shows an alternate embodiment of the in-line priming device 10 having a substantially straight tubular member 12 which is not L-shaped. Other shapes and configurations may also be utilized which are best suited for the end-use.

In operation, the front-end 14 of the tubular member 12 is connected and sealed to the vacuum hose 28 and the rear-end 16 of the tubular member 12 is connected and sealed to the basket plate 36, said basket plate 36 connected and sealed to the skimmer/filter basket 34. Connection and seal with the hydraulic pump 30 is made via an opening in the base of the skimmer/filter basket 34, as found in a conventional poolside skimmer/vacuum system 26. The in-line priming device 10 is substantially submerged at the intake port of the skimmer/filter basket and the plurality of apertures 22 are completely covered by fluid (e.g. water).

In operation, one or more covers 24 are adjusted with reference to the indicia 32 so that some of the plurality of apertures 22 are unobstructed and completely open. As the hydraulic pump 30 begins to pump, it draws fluid out of the skimmer/filter basket 34 through the plurality of apertures 22 so as to not lose its priming. If a substantial quantity of air enters the hydraulic pump 30, priming is lost. While drawing fluid through the plurality of apertures 22, the hydraulic pump 30 also continues to draw a fluid/air mixture through the vacuum hose 28, thereby introducing fluid into the vacuum hose, until all of the air has passed through the filter system and the vacuum hose 28 is substantially filled with fluid.

After the vacuum hose 28 is substantially purged of air, said air capable of causing the hydraulic pump to operate abnormally and loose its prime, the one or more covers 24 are adjusted with reference to the indicia 32 such that the plurality of apertures 22 are slightly more closed. This allows for complete removal of the remnants of air remaining in the vacuum hose 28. Complete closing of the plurality of apertures 22 allows the full effect of the vacuum system to be directed through the vacuum hose 28 so that the pool skimming operation may begin.

From the foregoing description those skilled in the art will appreciate that all objects of the present invention are realized. An in-line priming device has been shown and described which prevents a hydraulic pump from loosing its prime.

The device of this invention is convenient and easy to use. The preferred design of the present invention, as well as alterations that will now be apparent to those skilled in the art, all allow use of the device with any conventional poolside skimmer/vacuum system. The device of this invention is further characterized by relatively precise control of the air and fluid flow rate.

The present invention, in alternate embodiments, is available in a variety of shapes and sizes.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A method for purging air from a swimming pool hose, containing a fluid/air mixture, connected to a hydraulic vacuum pump through a skimmer/filter basket of a poolside skimmer, the method comprising the steps of:

providing an in-line tubular member comprising a front-end, a rear-end, an outer surface, an inner surface, one or more apertures interdisposed between the front-end and the rear-end, and one or more covers capable of substantially closing said one or more apertures, said one or more apertures extending from the outer surface of the in-line tubular member to the inner surface of the in-line tubular member;

connecting the front-end of the in-line tubular member to a swimming pool vacuum hose and the rear-end of the in-line tubular member to the hydraulic pumping suction of a poolside skimmer/filter basket such that said one or more apertures are substantially immersed in water;

opening one or more of the one or more covers for an optimum time interval to allow water to be siphoned through the one or more apertures and into the hydraulic pump such that the hydraulic pump establishes and maintains its prime while evacuating air from the vacuum hose;

closing the one or more covers after the air has been purged from the vacuum hose such that hydraulic pump siphons water through the vacuum hose and not through the one or more apertures.

2. A method for purging air from a swimming pool hose as defined in claim 1 further comprising the steps of connecting the rear-end of the in-line tubular member to the hydraulic pumping suction of a poolside skimmer/filter basket by;

providing a basket plate having a topside and a bottom side, said topside of said basket plate capable of sealingly connecting to said rear-end of the in-line tubular member and said bottom side of said basket plate capable of sealingly connecting to said skimmer/filter basket on its topmost suction side nearest a pool's water surface;

connecting said rear-end of the in-line tubular member to said top side of said basket plate and;

connecting said bottom side of said basket plate to the topmost suction side of said skimmer/filter basket nearest the pool's water surface.

* * * * *